US007007351B2

(12) United States Patent
Ausen et al.

(10) Patent No.: US 7,007,351 B2
(45) Date of Patent: Mar. 7, 2006

(54) HEAT TREATED HIGH DENSITY STRUCTURES

(75) Inventors: Ronald W. Ausen, St. Paul, MN (US); Jayshree Seth, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/786,486

(22) Filed: Feb. 25, 2004

(65) Prior Publication Data

US 2004/0163222 A1 Aug. 26, 2004

Related U.S. Application Data

(62) Division of application No. 10/321,899, filed on Dec. 17, 2002.

(51) Int. Cl.
*A44B 18/00* (2006.01)

(52) U.S. Cl. ..... 24/452

(58) Field of Classification Search ..... 24/442–452; 264/167

See application file for complete search history.

(56) References Cited

U.S. PATENT DOCUMENTS

| | | | | |
|---|---|---|---|---|
| 3,266,113 | A | 8/1966 | Flanagan, Jr. | |
| 3,557,413 | A | 1/1971 | Engle | |
| 4,001,366 | A | 1/1977 | Brumlik | |
| 4,056,593 | A | 11/1977 | de Navas Albareda | |
| 4,189,809 | A | 2/1980 | Sotos | |
| 4,497,860 | A * | 2/1985 | Brady, Jr. | 428/156 |
| 4,894,060 | A | 1/1990 | Nestegard | |
| 5,011,642 | A | 4/1991 | Welygan et al. | |
| 5,040,275 | A * | 8/1991 | Eckhardt et al. | 24/442 |
| 5,176,670 | A * | 1/1993 | Roessler et al. | 604/391 |
| 5,315,740 | A | 5/1994 | Provost | |
| 5,398,387 | A | 3/1995 | Torigoe et al. | |
| 5,672,186 | A | 9/1997 | Chesley et al. | |
| 6,066,281 | A | 5/2000 | Provost | |
| 6,131,251 | A * | 10/2000 | Provost | 24/452 |
| 6,209,177 | B1 | 4/2001 | Murasaki | |
| 6,303,062 | B1 | 10/2001 | Aamodt et al. | |

(Continued)

FOREIGN PATENT DOCUMENTS

| | | |
|---|---|---|
| FR | 2 082 591 | 12/1971 |

(Continued)

OTHER PUBLICATIONS

Web Page of ULTRA-MATE® Brand HTH via http://web.archive.org/web/*/http://www.velcro.com/industrial/ultimate.html, Jun. 16, 2001, one page.*

*Primary Examiner*—Robert J. Sandy
(74) *Attorney, Agent, or Firm*—William J. Bond

(57) ABSTRACT

A method for forming a unitary polymeric projection or fastener comprising a base layer, and a multiplicity of spaced projections or hook members projecting from the upper surface of the unitary base layer the method generally including extruding of forming a thermoplastic resin through a die plate or mold. A die plate, if used, is shaped to form a base layer and spaced ridges, projecting above a surface of the base layer. When the die forms the spaced ridges or ribs the cross sectional shape of the projections are formed by the die plate. The ridges are then cut at spaced locations along their lengths to form discrete cut portions of the ridges. The cut portions are then heat treated resulting in shrinkage of at least a portion of at least the cut portion thickness by from 5 to 90 percent, preferably 30 to 90 percent thereby forming discrete upstanding projections.

9 Claims, 3 Drawing Sheets

U.S. PATENT DOCUMENTS

| | | | | |
|---|---|---|---|---|
| 6,484,371 | B1 | 11/2002 | Romanko et al. | |
| 6,623,469 | B1 * | 9/2003 | Thomas | 24/451 |
| 6,684,464 | B1 * | 2/2004 | Mody et al. | 24/442 |
| 6,687,962 | B1 * | 2/2004 | Clarner et al. | 24/452 |
| 6,730,069 | B1 * | 5/2004 | Tanzer et al. | 24/442 |
| 6,756,327 | B1 * | 6/2004 | Martin | 24/452 |
| 2001/0000365 | A1 * | 4/2001 | Provost et al. | 24/452 |
| 2002/0162197 | A1 | 11/2002 | Romanko et al. | |
| 2003/0145440 | A1 | 8/2003 | Ausen et al. | |
| 2003/0182776 | A1 | 10/2003 | Ausen et al. | |
| 2004/0068848 | A1 | 4/2004 | Ausen et al. | |
| 2004/0130056 | A1 * | 7/2004 | Harvey et al. | 264/167 |

FOREIGN PATENT DOCUMENTS

| | | |
|---|---|---|
| JP | 2-17006 | 1/1990 |
| WO | WO 03/059108 | 7/2003 |

* cited by examiner

HEAT TREATED HIGH DENSITY STRUCTURES

CROSS REFERENCE TO RELATED APPLICATIONS

This application is a divisional of U.S. application Ser. No. 10/321,899, filed Dec. 17, 2002, now pending.

BACKGROUND AND SUMMARY

The present invention concerns molded hook fasteners for use with hook and loop fasteners.

BACKGROUND OF THE INVENTION

There are a variety of methods known to form hook materials for hook and loop fasteners. One solution is generally the use of continuous extrusion methods that simultaneously form the base layer and the hook elements, or precursors to the hook elements. With direct extrusion molding formation of the hook elements, see for example U.S. Pat. No. 5,315,740, the hook elements must continuously taper from the base layer to the hook tip to allow the hook elements to be pulled from the molding surface. This generally inherently limits the individual hooks to those capable of engaging only in a single direction while also limiting the strength of the engaging head portion of the hook element, as well as the density of the hook structures, which generally must point in the machine direction.

An alternative direct molding process is proposed, for example, in U.S. Pat. No. 4,894,060, which permits the formation of hook elements without some of these limitations. Instead of the hook elements being formed as a negative of a cavity on a molding surface, the basic hook cross-section is formed by a profiled extrusion die. The die simultaneously extrudes the film base layer and rib structures. The individual hook elements are then formed from the ribs by cutting the ribs transversely followed by stretching the extruded strip in the direction of the ribs. The base layer elongates but the cut rib sections remain substantially unchanged. This causes the individual cut sections of the ribs to separate each from the other in the direction of elongation forming discrete hook elements. Alternatively, using this same type extrusion process, sections of the rib structures can be milled out to form discrete hook elements. However, this approach is not commercially viable due to the speed of the milling operation. With this profile extrusion, the basic hook cross section or profile is only limited by the die shape and hooks can be formed that extend in two directions and have hook head portions that need not taper to allow extraction from a molding surface. This is extremely advantageous in providing higher performing and more functionally versatile hook structures.

BRIEF DESCRIPTIONS OF THE INVENTION

The present invention provides a method for forming unitary polymeric structures comprising a polymeric base layer, and a multiplicity of spaced projections, projecting from at least one surface of the base layer. The method of the invention generally can be used to form upstanding projections, which may or may not be hook members that project upwardly from the surface of a polymeric film base layer. If the projections form hook members each projection comprises a stem portion attached at one end to the base layer, and a head portion at the end of the stem portion opposite the base layer. A head portion can also extend from a side of a stem portion. If a head portion is omitted entirely alternative projections can be formed which can be used for purposes other than as hook members. Multiple types of projections having different purposes can be produced on a single base layer as well. For hook members, a head portion preferably projects past the stem portion on at least one of two opposite sides. In the invention method, at least a portion of each projection precursor is heat treated so as to decrease the projection precursor thickness and thereby separating a projection from an adjacent projection. This heat treating also tends to reduce or eliminate molecular orientation in at least the heat treated portion of the projection in the machine direction.

The structured invention projections are preferably made by a novel adaptation of a known method of making hook fasteners as described, for example, in U.S. Pat. Nos. 3,266,113; 3,557,413; 4,001,366; 4,056,593; 4,189,809 and 4,894,060 or alternatively 6,209,177. The preferred method generally includes extruding a thermoplastic resin through a die plate, which die plate is shaped to form a base layer and spaced ridges or ribs projecting above a surface of the base layer. These ridges generally form the cross-section shapes of the desired projection to be produced. The die forms the spaced ridges and induces machine direction molecular orientation in the ridges by directing the molten polymer flow in the machine direction (the direction of polymer flow or extrusion). These ridges or ribs will also form the cross sectional shape of the projections as the ridges are formed by the die plate. The initial projection precursor thickness is formed by transversely cutting the ridges at spaced locations along their lengths to form discrete cut portions of the ridges. These cut portions are directly adjacent one another along the cut line so at this point they do not form discrete projections or form projections separated by only a minimal distance. In the past, longitudinal stretching of the base layer (in the direction of the ridges or the machine direction) would separate these cut portions of the ridges, which now separated cut portions would form spaced apart hook members based on the profile of the extruded ridge. However, in the present invention, cut rib or ridge portions are simply heat treated without stretching. The heat treatment results in shrinkage of at least an uppermost portion of the cut portion thickness by from 5 to 90 percent, preferably 30 to 90 percent. This causes a separation of the cut portion generally of at least 10 $\mu$m, preferably at least 50 $\mu$m thereby forming the discrete projection. The heat treatment can then continue to shrink more or all of the cut portion (e.g., at least a portion of the stem portion of the hook members or down as far as the cut of the cut portion). The resulting heat treated projections, preferably hooks, are preferably substantially upstanding and/or rigid.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENT

Figure 1:
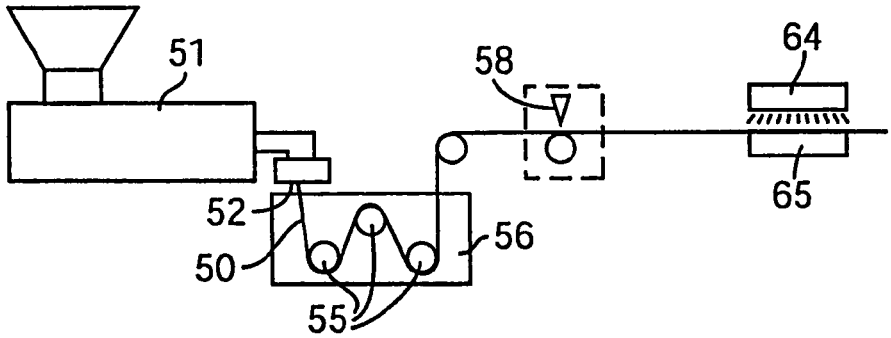
FIG. 1 schematically illustrates a method for making the hook fastener portion of FIGS. 4–7.

Referring to FIGS. 4–7, polymeric hook fastener portions which can be produced, or heat treated according to the present invention are illustrated. A hook portion is generally designated by the reference numeral 10. The hook fastener portion 10 comprises a film-like base layer 11 having generally parallel upper and lower major surfaces 12 and 13, and a multiplicity of spaced hook members 14 projecting from at least the upper surface 12 of the base layer 11. The base layer can have planar surfaces or surface features as could be desired for tear resistance or reinforcement. The hook members 14 each comprise a stem portion 15 attached at one end to the base layer 11 and a head portion 17, preferably at the end of the stem portion 15 opposite the base layer 11. The head portion 17 has hook engaging parts or arms 36, 37 projecting past the stem portion 15 on one or both sides of the stem portion. The hook member shown in FIGS. 7*a* and 7*b* has a rounded surface 18 opposite the stem portion 15 to help the head portion 17 enter between loops in a loop fastener portion.

Figure 7A:
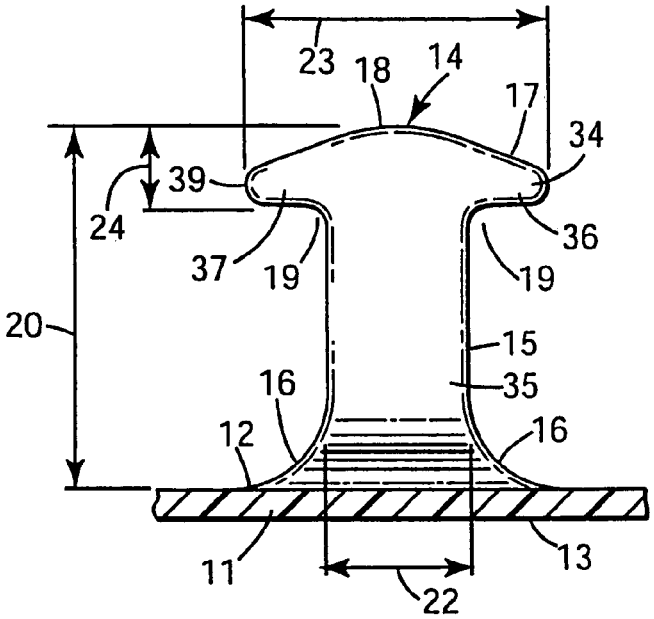
FIG. 7*a* is a schematic front view of a hook member of the present invention.
Figure 7B:
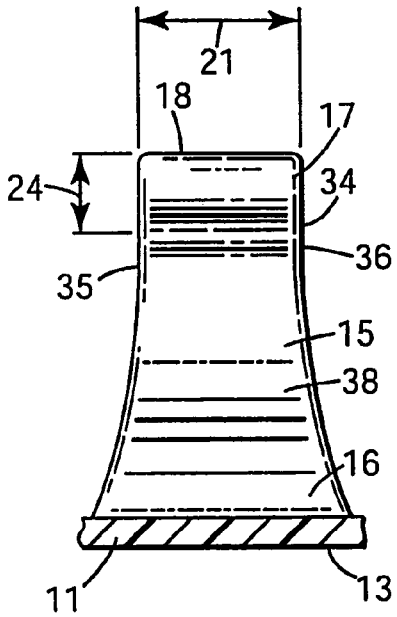
FIG. 7*b* is a schematic side view of a hook member of the present invention.

With reference to FIGS. 7*a* and 7*b*, there is shown a single representative one of the small hook members 14 on which its dimensions are represented by reference numerals between dimensional arrows. The height dimension is 20. The stem and head portions 15 and 17 have a thickness dimension 21, which as shown is the same at the point where the head joins the stem, and the head portions 17 have a width dimension 23 and an arm droop 24. The stem portion has a width dimension 22 at its base before flaring 16 to the base film 11. The thickness as shown is for a hook wherein the stem thickness gradually increases from the top of the stem to the bottom of the stem at which point the stem is joined to the polymeric backing. With other shapes, the thickness can be measured as the shortest distance between two opposing sides 34 and 35. Likewise, the width dimension can be measured as the shortest distance between two opposing sides.

Figure 2:
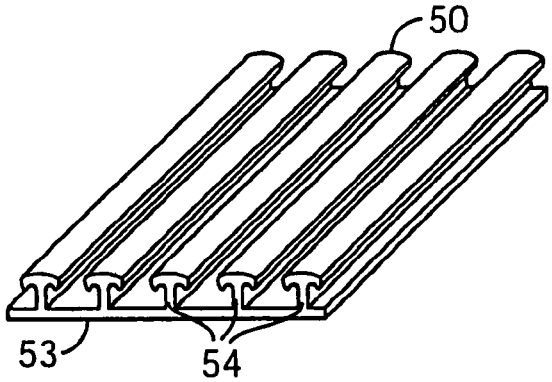
FIGS. 2 and 3 illustrate the structure of a strip at various stages of its processing in the method illustrated in FIG. 1.
Figure 3:
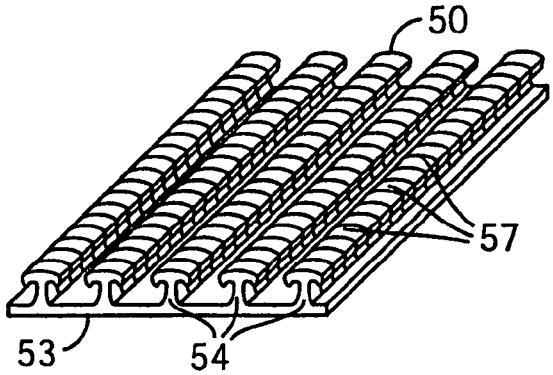
Figure 4:
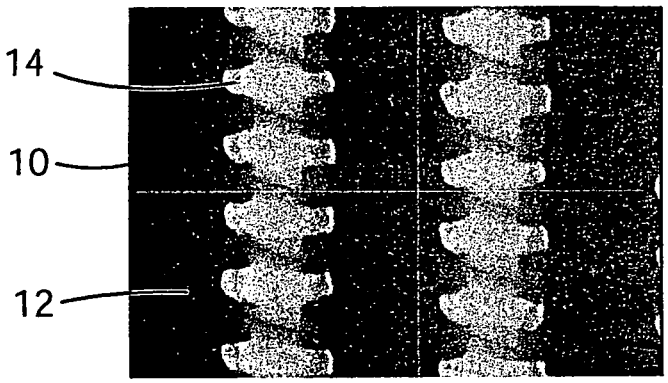
FIG. 4 is a top view of a hook member on a hook portion of formed by heating a strip such as shown in FIG. 3.
Figure 5:
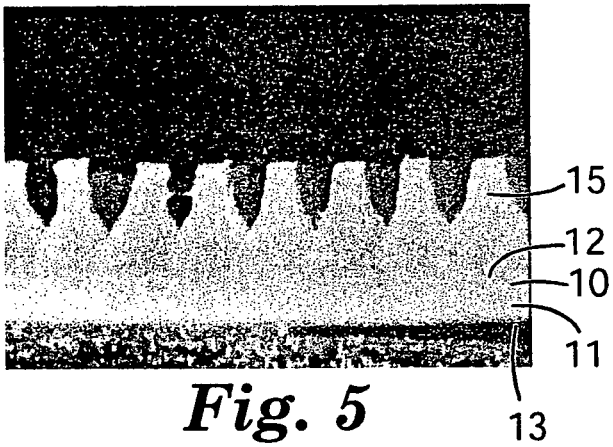
FIGS. 5 and 6 are side views of the hook members of FIG. 4 heat treated to different extents.
Figure 6:
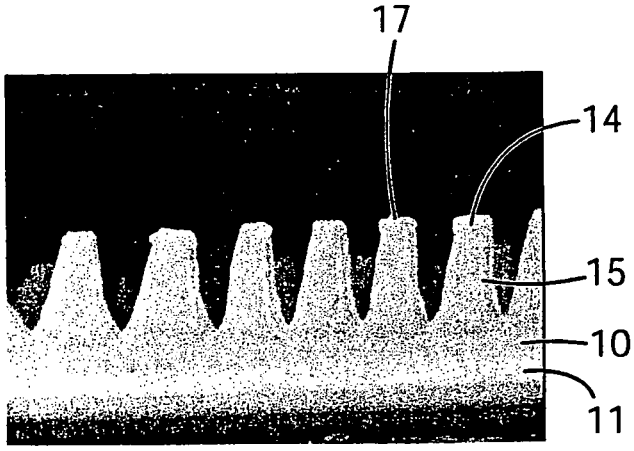

A first embodiment method for forming a hook fastener portion, such as that of FIG. 4, is schematically illustrated in FIG. 1. Generally, the method includes first extruding a strip 50 shown in FIG. 2 of thermoplastic resin from an extruder 51 through a die 52 having an opening cut, for example, by electron discharge machining, shaped to form the strip 50 with a base 53 and elongate spaced ridges or ribs 54 projecting above an upper surface of the base layer 53 that have the cross sectional shape of the projections or hook members to be formed. The strip 50 is pulled around rollers 55 through a quench tank 56 filled with a cooling liquid (e.g., water), after which the ridges or ribs 54 (but not the base layer 53) are transversely slit or cut at spaced locations along their lengths by a cutter 58. The cutter forms discrete portions 57 of the ribs 54 having lengths corresponding to about the desired initial thicknesses of the cut portions to be formed into discrete projections, as is shown in FIG. 3. Different cut angles or periods can also be used on the same strip, if desired. The cut can be at any desired angle, generally from 90° to 30° from the lengthwise extension of the ribs. Optionally, the strip can be stretched prior to cutting to provide further molecular orientation to the polymers forming the ribs (increasing their ability to shrink when cut and heat treated) and/or reduce the size of the ribs and the resulting hook members formed by slitting of the ribs. The cutter 58 can cut using any conventional means such as reciprocating or rotating blades, lasers, or water jets, however preferably it cuts using blades oriented at an angle of about 60 to 80 degrees with respect to lengthwise extension of the ribs 54.

The temperature and duration of the heating should be selected to cause shrinkage or thickness reduction of at least the top portion of the cut portion by from 5 to 90 percent. The non-contact heating source can include radiant, hot air, flame, UV, microwave, ultrasonics or focused IR heat lamps. This heat treating can be over the entire strip containing cut portions to form projections or hook portions or can be over only a portion or zone of the strip. Or different portions of the strip can be heat treated to more or less degrees of treatment to create projections having different characteristics. In this manner, it is possible, for example, to obtain on a single hook strip, hook containing areas with different levels of performance without the need to extrude different shaped rib profiles. This heat treatment can change projections or hook elements continuously or in a gradient across a region of the strip. In this manner, the projections or hook elements can differ continuously across a defined area of the hook fastener portion. Further in this defined area, the projection or hook density can be the same in the different regions coupled with substantially the same film base layer caliper or thickness (e.g., 50 to 500 microns). The extruded strip can easily be made to have substantially the same basis weight and the same relative amount of material forming the ridges and base layer in all regions despite the difference in subsequent cutting and/or heat treating. The differential heat treatments can be along different rows or can cut across different rows, so that different types of projections or hooks, such as having different thicknesses or cross-sectional profiles, can be obtained in a single or multiple rows in the machine direction (lengthwise direction) or transverse direction of the hook strip. The heat treatment can be performed at any time following creation of the cut portions of the ridges or ribs, such that customized performance can be created without the need for modifying the basic strip extrusion manufacturing process.

FIGS. 4–7 show a hook member of the FIG. 3 cut hook after it has been heat treated to cause a reduction in the thickness 21 of the hook head portion 17. The other dimensions of the hook member can also change which is a result of conservation of mass. The height 20 generally increases a slight amount and the head portion width 23 increases as does the arm droop 24. The stem and head portions have a thickness dimension 21 that is nonuniform and tapers from the base to the head portion due to the incomplete heat treatment along the entire hook member 14. Generally the untreated portion has a thickness up to the original thickness of the cut portion. The generally fully heat treated cut portion will have a uniform thickness 21 with a transition zone separating the untreated and treated portions. In this embodiment, the incomplete heat treatment also results in variation of the thickness 21 of the hook head portion from the arm tip 39 to the arm portion 36, 37 adjacent the stem 15.

Reduction in the projection or hook member thickness is caused by relaxation of at least the melt flow induced molecular orientation of the projection (e.g., the hook head and/or stem portion) which is in the machine direction, which generally corresponds to the thickness direction. Also, reduction in thickness can occur where there is stretch induced molecular orientation, as where ribs are stretched longitudinally prior to cutting. Melt flow induced molecular orientation is created by the melt extrusion process as polymer, under pressure and shear forces, is forced through the die orifice(s). The rib or ridge forming sections of the die create the melt flow induced molecular orientation in the formed ribs. This melt flow induced molecular orientation extends longitudinally or in the machine direction along the ribs or ridges. Stretch induced molecular orientation can be created by longitudinal stretching of the formed strips, regardless of whether they have melt flow induced orientation. When the ribs or ridges are cut, the molecular orientation should extend generally in the thickness dimension of the cut rib portions, however, the molecular orientation can extend at an angle of from about 0 to 45 degrees to the cut portion thickness. The initial molecular orientation in the cut portions intended to form the projections or hook members, is generally at least 10 percent, preferably 20 to 100 percent.

When the cut portions are heat treated in accordance with the invention, the molecular orientation of the cut portions decrease and the resulting projection or hook member thickness dimension decreases. The amount of thickness reduction depends primarily on the amount of cut portion molecular orientation extending in the machine direction or hook thickness dimension. The heat treatment conditions, such as time of treatment, temperature, the nature of the heat source and the like can also effect the cut portion thickness reduction. As the heat treatment progresses, the reduction in cut portion, or projection thickness extends from the top portion, to the base or stem portion down the projection to the base, until the entire cut portion thickness has been reduced. Generally, the thickness reduction is substantially the same in the formed projection as one goes down the projection, when fully heat treated or partially heat treated to the same extent. When only a part of the projection is heat treated, there is a transition zone where the thickness increases from the upper heat treated portion to the substantially non-heat treated portion, which has a substantially unreduced thickness. When the thickness dimension shrinks, the width of the treated portion generally increases, while the overall projection height increases slightly and for a hook the arm droop increases. The end result is a projection or hook member arranged closely spaced in a row where the spacing is one that can either, not be economically produced directly, or cannot be produced at all by conventional methods. The heat treated projection, generally the hook head, and optionally stem, is also characterized by a molecular orientation level of less than 10 percent, preferably less than 5 percent whereas the base film layer orientation is substantially unreduced. Generally, the hook member stem or projection orientation immediately adjacent the base film layer will be 10 percent or higher, preferably 20 percent or higher.

The heat treatment is generally carried out at a temperature near or above the polymer melt temperature. As the heat gets significantly above the polymer melt temperature, the treatment time decreases so as to minimize any actual melting of the polymer in the hook head portion or top of the projection. The heat treatment is carried out at a time sufficient to result in reduction of the thickness of the hook head, and/or stem, but not such that there is a significant deformation of the base layer or melt flow of the hook head portion or top of the projection. Heat treatment can also result in rounding of the hook head portion edges, improving tactile feel for use in garment applications.

The invention projections can be arranged in very close proximity, for example, if closely spaced hooks or projections are desired, there can be 25/cm or more hooks or projections in a single row. A row is defined by hooks or projections that extend in a direction or extent and at least partially overlap in that direction or extent, preferably overlap by 50 percent or more most preferably 90 percent or more. Preferably, the hooks or projections can be at least 30/cm even 50/cm or more up to 100/cm or possibly more. The overall density of the projections or hook members can be extremely high based on the closeness and width of the original rib members. If the rib members are closely spaced, extremely high hook densities are possible. Wider spacing between rib members can be created after the ribs are formed by stretch orientation of the base in a direction transverse to the rib members or hook rows. This can be beneficial to reduce the base layer thickness and made it more softer or less rigid while maintaining high number of projections in a row.

Suitable polymeric materials from which the hook fastener portion can be made include thermoplastic resins capable of melt flow induced molecular orientation such as those comprising polyolefins, e.g. polypropylene and polyethylene, polyvinyl chloride, polystyrene, nylons, polyester such as polyethylene terephthalate and the like and copolymers and blends thereof. Preferably the resin is a polypropylene, polyethylene, polypropylene-polyethylene copolymer or blends thereof.

The base layer is preferably a formed film which preferably is thick enough to allow it to be attached to a substrate by a desired means such as sonic welding, heat bonding, sewing or adhesives, including pressure sensitive or hot melt adhesives, and to firmly anchor the projections and provide resistance to tearing when subject to peel or shear forces. The base layer, however, could be other extrudable shapes as would be known to those skilled in the art of extrusion. For example, when the formed film has hook members and is intended for use a fastener to be used on a disposable garment, the base layer should not be so thick that it is stiffer than necessary. Generally, the film base layer has a Gurley stiffness of 10 to 2000, preferably 10 to 200 so as to allow it to be perceived as soft when used either by itself or laminated to a further carrier base layer structure such as a nonwoven, woven or film-type base layer, which carrier base layer should also be similarly soft for use in disposable garments or articles. The optimum base layer thickness will vary depending upon the resin from which the strip is made, but will generally be between 20 $\mu$m and 1000 $\mu$m, and is preferably 20 to 200 $\mu$m for softer base layers.

EXAMPLES AND TEST METHODS

Test Methods

Hook Dimensions

The dimensions of the Examples and Comparative Example hook materials were measured using a Leica microscope equipped with a zoom lens at a magnification of approximately 25×. The samples were placed on a x-y moveable stage and measured via stage movement to the nearest micron. A minimum of 3 replicates were used and averaged for each dimension. As depicted generally in FIGS. 7*a* and 7*b*, hook width is indicated by distance 23, hook height is indicated by distance 20, arm droop is indicated by distance 24, and hook thickness is indicated by distance 21. Hook thickness was measured at the top of the hook and approximately 300 microns down the stem from the top of the hook.

Molecular Orientation and Crystallinity

The orientation and crystallinity is measured using X-ray diffraction techniques. Data is collected using a Bruker microdiffractometer (Bruker AXS, Madison, Wis.), using copper $K_\alpha$ radiation, and HiSTAR™ 2-dimensional detector registry of scattered radiation. The diffractometer is fitted with a graphite incident beam monochromator and a 200 micrometer pinhole collimator. The X-ray source consisted of a Rigaku RU200 (Rigaku USA, Danvers, Mass.) rotating anode and copper target operated at 50 kilovolts (kV) and 100 milliamperes (mA). Data is collected in transmission geometry with the detector centered at 0 degrees (2θ) and a sample to detector distance of 6 cm. Test specimens are obtained by cutting thin sections of the hook materials in the machine direction after removing the hook arms. The incident beam is normal to the plane of the cut sections and thus is parallel to the cross direction of the extruded web. Three different positions are measured using a laser pointer and digital video camera alignment system. Measurements are taken near the center of the head portion 17, near the midpoint of the stem portion 15, and as close as possible to the bottom of the stem portion 17 just slightly above the surface 12 of the backing 11. The data is accumulated for 3600 seconds and corrected for detector sensitivity and spatial linearity using GADDS™ software (Bruker AXS Madison, Wis.). The crystallinity indices are calculated as the ratio of crystalline peak area to total peak area (crystalline+amorphous) within a 6 to 32 degree (2θ) scattering angle range. A value of one represents 100 percent crystallinity and value of zero corresponds to completely amorphous material (0 percent crystallinity). The percent molecular orientation is calculated from the radial traces of the two-dimensional diffraction data. Background and amorphous intensities are assumed to be linear between the 2θ positions defined by traces (A) and (C) defined below. The background and amorphous intensities in trace (B) are interpolated for each element and subtracted from the trace to produce (B'). Plot of trace (B') has constant intensity in absence of orientation or oscillatory intensity pattern when preferred orientation present. The magnitude of the crystalline fraction possessing no preferred orientation is defined by the minimum in the oscillatory pattern. The magnitude of the oriented crystalline fraction is defined by the intensity exceeding the oscillatory pattern minimum. The percent orientation is calculated by integration of the individual components from trace (B').

Trace (A): leading background edge and amorphous intensity; 12.4–12.8 degrees (2θ) radially along χ, 0.5 degree step size.

Trace (B): random and oriented crystalline fractions, background scattering, and amorphous intensity; 13.8–14.8 degrees (2θ) radially along χ, 0.5 degree step size.

Trace (C): trailing background edge and amorphous intensity; 15.4 to 15.8 degrees (2θ) radially along χ, 0.5 degree step size.

Trace (B'): random and oriented crystalline fractions obtained by subtraction of amorphous and background intensity from trace (B).

scattering angle center of trace (A): (12.4 to 12.8) deg.=12.6 deg. 2θ center of trace (B): (13.8 to 14.8) deg.=14.3 deg. 2θ center of trace (C): (15.4 to 15.8) deg.=15.6 deg. 2θ

$$\text{Interpolation constant}=(14.3-12.6)/(15.6-12.6)=0.57$$

for each array element [i]:

$$\text{Intensity}_{(amorphous+background)}[i]=[(C[i]-A[i])*0.57]+A[i]$$

$$B'[i]=B[i]-\text{Intensity}_{(amorphous+background)}[i]$$

From a plot of B'[i] versus [i]:

$$B'_{(random)}[i]=\text{intensity value of minimum in oscillatory pattern}$$

$$B'_{(oriented)}[i]=B'[i]-B'_{(random)}[i]$$

Using a Simpson's Integration technique and the following areas the percent of oriented material is calculated.

$$B'[i]=\text{total crystalline area (random+oriented)}=\text{Area}_{(total)}$$

$$B'_{(oriented)}[i]=\text{oriented crystalline area}=\text{Area}_{(oriented)}$$

$$B'_{(random)}[i]=\text{random crystalline area}=\text{Area}_{(random)}$$

$$\%\ \text{oriented material}=(\text{Area}_{(oriented)}/\text{Area}_{(total)})\times 100$$

Precursor Hook Web

A mechanical fastener hook material web was made using the apparatus shown in FIG. 1. A polypropylene/polyethylene impact copolymer (SRC7-644, 1.5 MFI, Dow Chemical) pigmented with TiO2 (0.5%) was extruded with a 6.35 cm single screw extruder (24:1 L/D) using a barrel temperature profile of 177° C.–232° C.–246° C. and a die temperature of approximately 235° C. The extrudate was extruded vertically downward through a die having an opening cut by electron discharge machining. After being shaped by the die, the extrudate is quenched in a water tank at a speed of 6.1 meter/min with the water being maintained at approximately 10° C. The web was then advanced through a cutting station where the ribs (but not the base layer) were transversely cut at an angle of 23 degrees measured from the transverse direction of the web. The spacing of the cuts was 305 microns. There were approximately 10 rows of ribs or cut hooks per centimeter. The general profile of this hook is depicted in FIG. 7.

Comparative Example C1

The precursor hook web described above was longitudinally (MD) drawn approximately 3.65 to 1 between two pairs of nip rolls to further separate the individual hook elements after the cutting step without any heat treatment of the hook side of the web. There were approximately 15 rows of ribs or cut hooks per centimeter crossweb after drawing. The dimensions of the resulting non heat-treated hook material are shown in Table 1 below.

Example 1

The precursor hook web described above was subjected to a non-contact heat treatment on the hook side of the web by passing said web underneath a perforated metal plate at a speed of 2.4 meter/min producing hook members having a profile substantially as shown in FIG. 7. Hot air at a temperature of approximately 185° C., provided by a 15 kW electric heater, was blown through the perforations in the metal plate onto the hook side of the web at a velocity of approximately 3350 meter/min. The hooks were approximately 46 cm from the perforated plate. The smooth base film side of the web was supported on a chill roll at approximately 149° C. After heat treatment the web was cooled by passing the web over a chill roll maintained at 11° C. The dimensions of the resulting heat-treated hook material are shown in Table 1 below.

Example 2

The precursor hook web described above was subjected to a non-contact heat treatment on the hook side of the web using the following procedure. A 13 cm×43 cm piece of web was placed onto a 13 cm×43 cm steel plate (1.3 cm thick), hook-side up, and edge clamped to prevent the web from shrinking. Hot air from a Master brand hot air gun (14.5 amp) at 400° C. was blown vertically down onto the web by passing the air gun uniformly over the web for about 20 seconds. The hot air gun vent was set at 50%. The dimensions of the resulting heat-treated hook material are shown in Table 1 below.

TABLE 1

| Hook Material | Hook width (μm) | Hook Height (μm) | Arm Droop (μm) | Hook Thickness Top (μm) | Hook Thickness at 300 μm (μm) | Hooks/cm in a row in Machine Direction |
|---|---|---|---|---|---|---|
| Precursor | 384 | 521 | 74 | 349 | 324 | 30 |
| C1 | 374 | 494 | 69 | 319 | 324 | 8 |
| 1 | 508 | 594 | 130 | 124 | 203 | 30 |
| 2 | 553 | 616 | 156 | 120 | 164 | 30 |

We claim:

1. A unitary film structure of a polymeric resin comprising a film base layer having generally parallel upper and lower major surfaces and having projections being arranged in rows with at least 50 spaced projections per centimeter in a row projecting from at least the upper major surface of said film base layer, wherein the projections are hook members which have base portions and head portions that extend in a direction transverse to the direction of rows of the hook members.

2. A unitary hook fastener according to claim 1 wherein said polymeric material is a thermoplastic resin and the hook head has rounded corners.

3. A unitary hook fastener according to claim 1 wherein said polymeric resin comprises polyethylene, polypropylene, polypropylene-polyethylene copolymers or blends thereof.

4. The unitary hook fastener according to claim 1 wherein at least the hook head portion has a molecular orientation of less than 10 percent.

5. The unitary hook fastener according to claim 4 wherein the hook member base portion adjacent the film base layer has a molecular orientation of at least 10 percent.

6. The unitary hook fastener according to claim 4 wherein the film base layer is substantially unoriented.

7. A unitary film structure of a polymeric resin comprising a base film layer having generally parallel upper and lower major surfaces having projections being arranged in rows with at least 25 spaced projections per centimeter in a row projecting from at least the upper surface of said base wherein at least a head portion has a molecular orientation of less than 10 percent wherein the projections are book members which have base portions and head portions that extend in a direction transverse to the direction of rows of the hook members.

8. The unitary hook fastener according to claim 7 wherein the hook member base portion adjacent the base has a molecular orientation of at least 10 percent.

9. The unitary book fastener according to claim 7 wherein die base film layer is substantially unoriented.

* * * * *

UNITED STATES PATENT AND TRADEMARK OFFICE

CERTIFICATE OF CORRECTION

PATENT NO. : 7,007,351 B2
APPLICATION NO. : 10/786486
DATED : March 7, 2006
INVENTOR(S) : Ausen, Ronald W.

It is certified that error appears in the above-identified patent and that said Letters Patent is hereby corrected as shown below:

Column 1,
Line 56, delete "DESCRIPTIONS" and insert -- DESCRIPTION --.

Column 6,
Line 58, delete "25x" and insert -- 25X --.

Column 10,
Lines 25 and 33, delete "book" and insert -- hook --.
Line 34, delete "die" and insert -- the --.

Signed and Sealed this

Twenty-seventh Day of June, 2006

JON W. DUDAS
*Director of the United States Patent and Trademark Office*